United States Patent [19]

Miller, Jr. et al.

[11] Patent Number: 5,018,447

[45] Date of Patent: May 28, 1991

[54] DEVICE AND METHOD FOR MONITORING THE PRESENCE OF AN OBJECT IN SPACE

[75] Inventors: Walter E. Miller, Jr.; Robert R. Mitchell; Donald E. Lovelace, all of Huntsville, Ala.

[73] Assignee: The United States of America as represented by the Secretary of the Army, Washington, D.C.

[21] Appl. No.: 518,620

[22] Filed: May 3, 1990

[51] Int. Cl.[5] ..... F42C 13/02

[52] U.S. Cl. ..... 102/213

[58] Field of Search ..... 102/213

[56] References Cited

U.S. PATENT DOCUMENTS 3,226,557 12/1965 Goodman ..... 102/213
3,455,243 7/1969 Martin ..... 102/213
3,786,757 1/1974 Godlstein et al. ..... 102/213
4,776,274 10/1988 Kriz et al. ..... 102/213

*Primary Examiner*—Charles T. Jordan
*Attorney, Agent, or Firm*—Freddie M. Bush; Hay Kyung Chang

[57] ABSTRACT

An optically transparent cylinder having a hemispherical cavity at one end thereof and containing at least one light source and one light detector inside the hemispherical cavity utilizes the prismatic effect of the cylinder to locate an object in space. The light source and detector are located on a disk whose insertion depth into the cavity and tilt angle inside the cavity can be varied to control the sharpness, width and direction of the conical beam output from the cylinder, the beam searching the space for the location of the desired object.

15 Claims, 3 Drawing Sheets

DEVICE AND METHOD FOR MONITORING THE PRESENCE OF AN OBJECT IN SPACE

DEDICATORY CLAUSE

The invention described herein may be manufactured, used, and licensed by or for the Government for governmental purposes without the payment to us of any royalties thereon.

BACKGROUND OF THE INVENTION

Some anti-aircraft missiles use proximity fusing to sense when the distance between the missile and the approaching target is within a lethal range and detonate the warhead as soon as that criterion is met. This reduces demands placed on the level of accuracy required of the missile guidance system since a "near-miss" can become as effective as a "hit". Other missiles with "smart" fuses detect the target in the last phases of its flight and attempt to determine a point of closest approach for maximizing lethality during a "near-miss" missile fly-by. The very rapid relative closing velocities of the missile and the target, the target evasion capabilities and possible maneuver accelerations of the target all impose increasing demands on warhead and fusing technologies to support high performance anti-air or anti-missile engagements. In such engagements, there usually is a much shorter window of time during which fusing and warhead detonation must occur in order to be effective. One approach to improving warhead effectiveness in such engagements is the use of focused fragment warheads. These warheads are aimable and, thus, concentrate a large number of fragments in a chosen direction, i.e. the direction of the target. To use such an aimable warhead, an improved target fuse is needed which can determine the best direction for the warhead to fire as well as the best time to fire.

SUMMARY OF THE INVENTION

The missile guidance system generates information regarding the sight line direction approximate position and closing velocity of the target in relation to the missile. The device and method for detecting the presence of an object in space uses this information to calculate the optimum geometry of a fuse beam which is projected in the shape of the surface of a cone, and whose apex is on the missile. The desired cone angle sharpness and tilt angle are determined from the target sight line direction and closing velocity. The conical beam of light emanates from an optical proximity fuse which is built into the missile and is an optically transparent cylinder, with an internal source of light. The cylinder emits a cone-shaped beam outwardly with the desired cone angle sharpness and tilt angle. When a target crosses the conical shaped fuse beam, the target reflects some of the light back toward the detectors located inside the cylinder. The location of the particular detector inside the cylinder which receives the reflected light is used to determine the direction in which the missile warhead must be fired to hit the target.

DESCRIPTION OF THE PREFERRED EMBODIMENT

Figure 1:
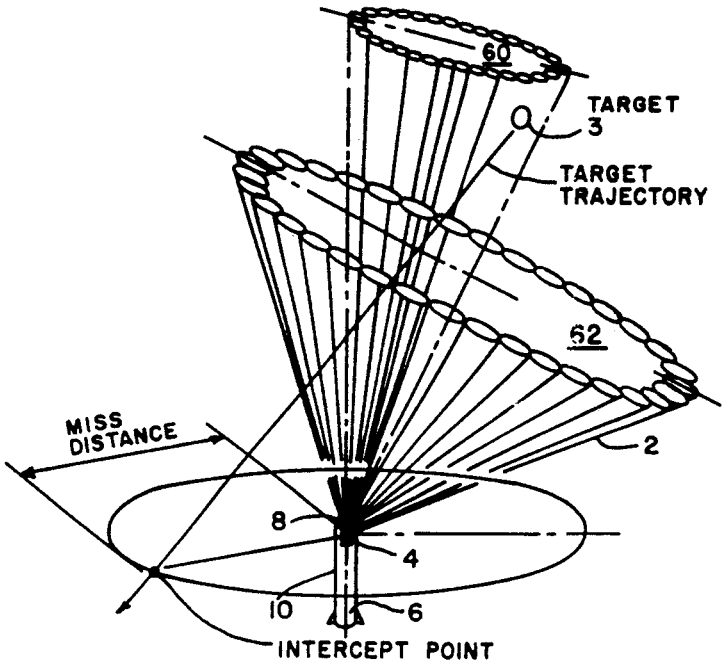
FIG. 1 shows how the conical beam from the optical proximity fuse illuminates the target space.

Referring now to the drawings wherein like numbers refer to like parts, FIG. 1 shows how a possibly segmented conical beam 2 emanating from fuse 4 within the missile 6 is used to illuminate target space. Fuse 4 is located between forebody 8 of the missile and aftbody 10 of the missile. Depending on the target information such as, for example, approximate position, trajectory and velocity, provided by the missile guidance system, the optimum fusing geometry is selected during the missile flight. Such an optimum fusing geometry can be a "look mostly forward" narrow cone 60, a "look outward to the side" broad disk-like cone 62 or any cone whose shape is between these two extreme conical shapes. Further, the conical beam of any given apical angle may be tilted on its apex toward one or the other side of the missile as necessary to better detect the approaching target.

Figure 2:
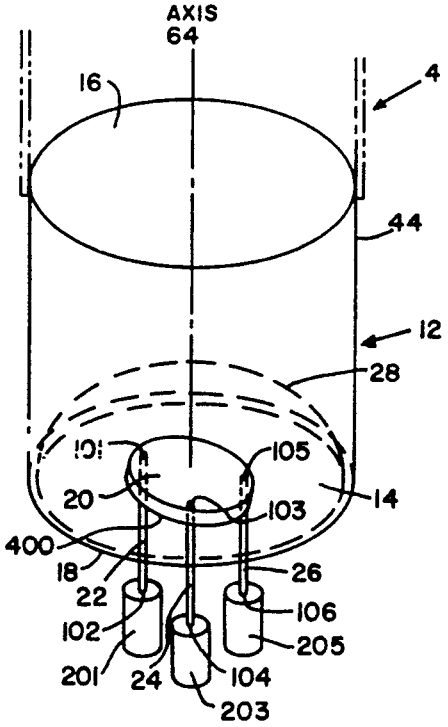
FIG. 2 is a detailed view of the optical proximity fuse.

FIG. 2 shows details of the programmable optical proximity fuse 4. A right circular cylinder 12 of approximately 8 inches in diameter and 10 inches in height is located between the forebody 8 and aftbody 10 of the missile, securely held in place by screws or any other suitable means. Further, a center backbone or other strengthening structure to attach the fuse to the missile may be necessary depending on the acceleration maneuver levels required of the missile during its flight.

Cylinder 12 is made of solid transparent material such as glass or transparent plastic and has a flat top 16 and, at base 18, has hemispherical cavity 14 of radius of approximately 4 inches. Into cavity 14 is inserted a disk 20 which is supported by plurality of rods 22, 24, and 26 as shown in FIG. 2. The rods support the disk via suitable mechanism such as ball-and-socket hinges that couple tops 101, 103 and 105 of the rods with second surface 400 of disk 20. The bottoms 102, 104 and 106 of rods 22, 24, and 26, respectively, are coupled to suitable mechanism such as drive motors 201, 203, and 205, respectively. The motors drive the rods to vary the insertion depths of the rods inside cavity 14. By uniformly moving the rods an equal distance in a direction parallel with cylinder axis 64, only the insertion depth of disk 20 inside cavity 14 is varied, without changing the tilt angle of the disk. However, moving the several rods by unequal distances would result in the disk being tilted. By choosing different distances by which the rods are moved, disk 20 may be tilted in any plane intersecting the cylinder axis 64. Disk 20 may also be supported by a single rod which is suitably coupled to second surface 400 of the disk at the center of the disk. The bottom of the rod is coupled to a drive motor which performs to vary the insertion depth of the rod hence the disk inside hemispherical cavity 14. Disk 20 may be inserted as deep or shallow into cavity 14 as desired so long as the disk does not come into contact with hemispherical surface 28 or leave cavity 14 entirely. Disk 20 may be any size as long as it is small enough to fit into cavity 14 and still have space left in the cavity to permit the disk to tilt in any direction without coming into contact with hemispherical surface 28.

Figure 3:
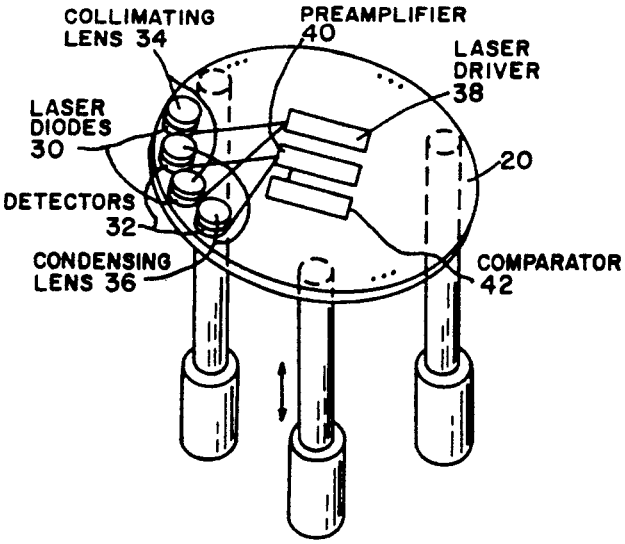
FIG. 3 shows the details of the disk.

FIG. 3 shows the detailed structure of disk 20 itself. On the disk, around its periphery, laser diodes 30 and detectors 32 are arranged in alternation to form a complete circle i.e. a laser diode next to a detector which is next to a laser diode and so on. In the following discussion, any statement made regarding a laser diode applies equally to all laser diodes 30 and any statement regarding a detector applies to all detectors 32. Each of laser diodes 30 and detectors 32 contain lenses therein which are about 0.2 inch in diameter. Spectra Diode Labs Model SDL-2420 series can be used to perform the function of the laser diodes and EG & G Corporation, SDG 100 can be used to function as the detectors. Laser driver 38 suitably located on disk 20 and coupled to laser diodes 30 supply power to the laser diodes which emit laser light. The light is, then, collimated by collimating lenses 34 which may be positioned on top of the diodes or in any other appropriate fashion which places the collimating lenses in the path of the laser light being emitted by the diodes. Therefrom, the collimated light impinges on hemispherical surface 28, is refracted by cylinder 12, travels through the cylinder in the refracted state and departs the cylinder at outer surface 44 of the cylinder, is refracted again, this time by the atmosphere, and continues its travel through space to infinity. If and when a target moves into the path of the light, part of the light is reflected by the target back toward the cylinder. The reflected light impinges on outer surface 44 of the cylinder, is refracted by the cylinder, travels through the cylinder, enters cavity 14 at hemispherical surface 28, is refracted by the gas inside the cylinder and finally impinges on one or more condensing lenses 36 mounted on detectors 32 or otherwise suitably positioned to focus the light onto the detectors. Depending on the position of the target in the target space, only a few detectors will receive light reflected from the target. Receipt of the reflected light by only a few detectors is due to the fact that the reflected light is only a small portion of the original conical beam of light and is directional in that it retraces its path back to the fuse. The reflected light detected by the particular detectors 32 is input to a pre-amplifier 40, which is coupled to the detectors, to be amplified. The amplified light is then transmitted to comparator 42 to which the pre-amplifier is coupled so that light reflected from a target can be distinguished from background illumination, by the comparator's transient time characteristic. If intensity of light variation transmitted into comparator 42 exceeds the pre-set level of intensity above electronic noise then the comparator activates, thus triggering the element to which it is coupled such as warhead fuse segment. The proper firing angle is determined by the location on disk 20 of the particular detector which receives the strongest reflected light impulse from the target.

Figure 4:
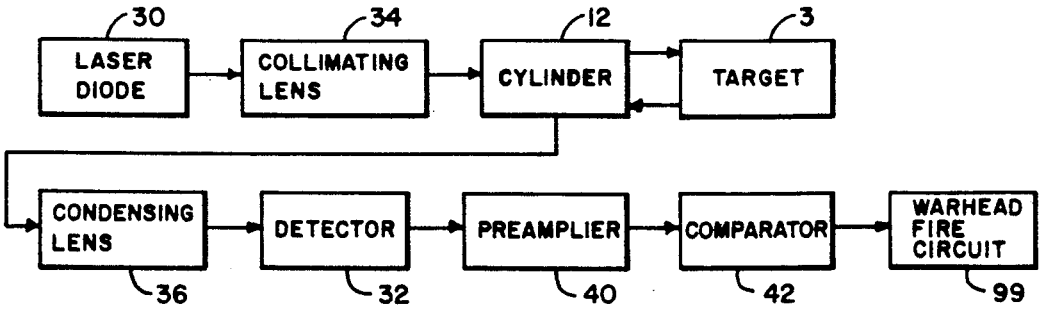
FIG. 4 is a block diagram of the progression of light from the fuse to target and back to the fuse.
Figure 5:
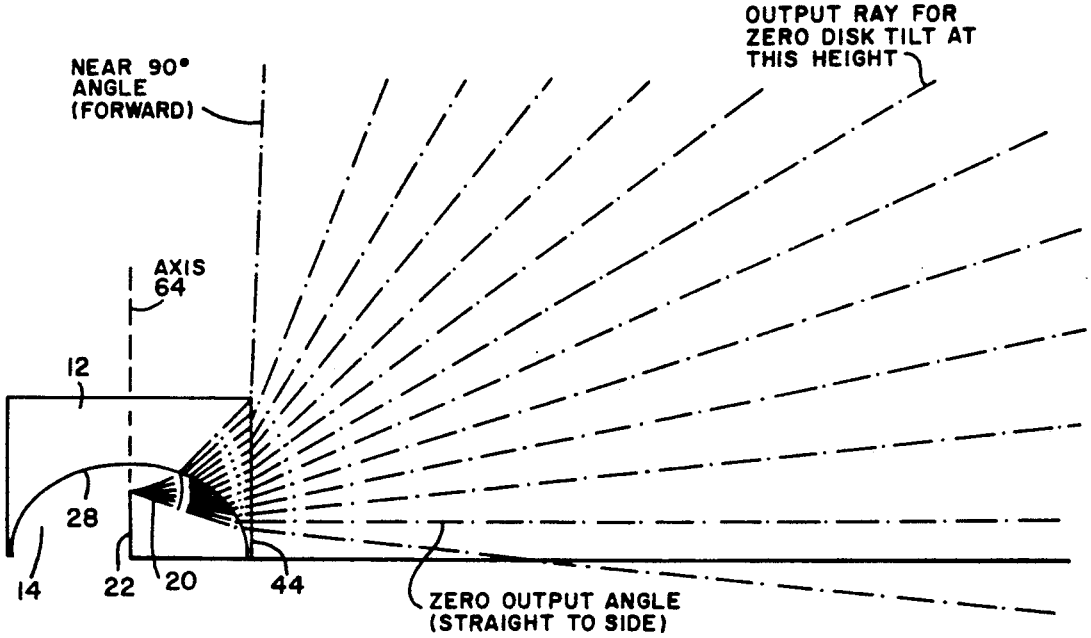
FIG. 5 is an illustration of output beam forward look angle based on fixed insertion depth of the disk into the cavity and variable disk tilt angle.
Figure 6:
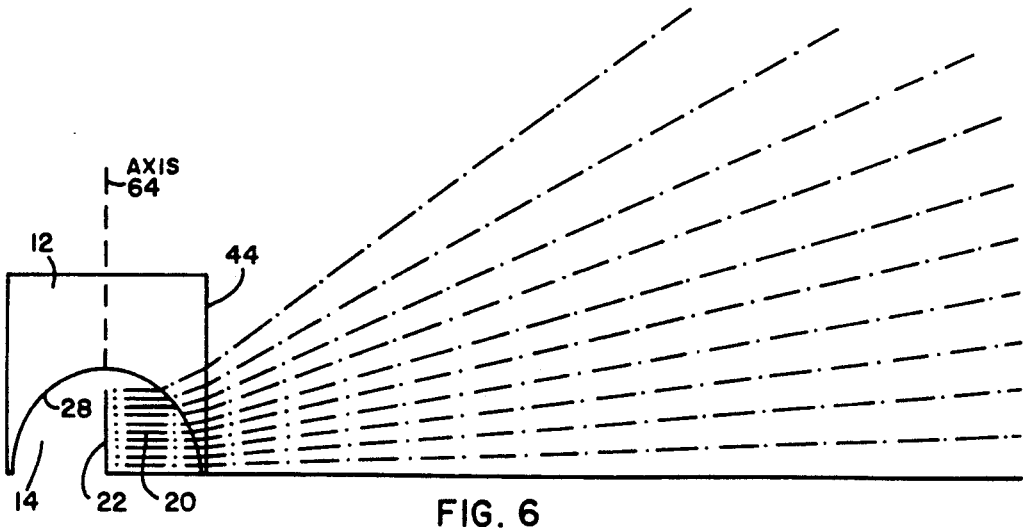
FIG. 6 is an illustration of output beam forward look angle based on fixed disk tilt angle and variable disk insertion depth.

A block diagram of the progression of light from the fuse to the target and back to the fuse is summarized in FIG. 4. Laser diode 30 emits the laser beam which is collimated by collimating lens 34 and emitted forth through cylinder 12. If and when a portion of the beam impinges on target 3, then the portion is reflected back through the cylinder to condensing lens 36. Therefrom the beam of light impinges on detector 32, is input to pre-amplifier 40 and to comparator 42 in succession. Comparator, then, activates whatever circuit that is coupled thereto, such as warhead fire circuit 99. The principle behind operation of the programmable optical proximity fuse can best be explained by ray-trace analysis. In the radial plane, that is, a plane perpendicular to the cylinder axis 64, a single plane analysis of cylinder 12 as a lens shows two concentric circular surfaces. When laser light, also emanating around the full 360 degrees circle from laser diodes 30 which are arranged in a circle, strikes this lens in this plane, it continues through with a small change in divergence angle, still covering the 360 degrees around the missile. However in a plane that is parallel with the cylindrical axis 64, the lens system consists, as shown in FIGS. 5 and 6, of a first surface which is a part of hemispherical surface 28 and hence spherical and a second surface, which is part of outer surface 44 of cylinder 12 and, hence, cylindrical. This lens is a variable prismatic optical system and is highly prismatic which is what makes it possible for the look-forward-capability of the fuse to approach parallelism with the cylindrical axis. The variable prismatic effects are illustrated in FIGS. 5 and 6. FIG. 5 shows the output beam coverage of the target space with one fixed insertion depth of rod 22 within hemispherical cavity 14 at variable tilt angles of disk 20. As can be seen in the figure, the output beam ranges all the way from straight out to the side, i.e. almost perpendicular to the cylindrical axis 64, to nearly directly forward of the missile, i.e. almost parallel with the cylindrical axis 64. This angular range is obtained by varying the disk tilt angle by small values. FIG. 6, on the other hand, shows the effect of varying the insertion depth of rod 22 while maintaining a fixed tilt angle of disk 20, here, 0 degrees. The more deeply the rod is inserted into cavity 14, the narrower the conical output beam apical angle for a sharper, more forward-looking field of view and the more shallowly the rod is inserted, the wider the output beam angle for a wider, more side-looking field of view. In both FIGS. 5 and 6, only the right half of the output beam is shown. The left half would be a mirror image except for the disk tilt angle, i.e. forward tilt replacing the aft tilt that is shown in FIG. 5. A compilation of the results of many such ray traces is presented in the following table wherein output beam angle in radian is presented as a function of A which is disk tilt angle in radian and H which is the insertion depth in inches.

TABLE OF OUTPUT BEAM ANGLES

| A | H = 3.5 | H = 3.0 | H = 2.5 | H = 2.0 | H = 1.5 |
|---|---|---|---|---|---|
| −.3 | .07 | −.0539 | −.1413 | | |
| −.2 | .241 | .1022 | .0090 | −.0637 | −.1252 |
| −.1 | .405 | .2537 | .1555 | .0804 | .0176 |
| 0 | .562 | .4012 | .2995 | .2227 | .1588 |
| .1 | .716 | .5464 | .4425 | .3644 | .2999 |
| .2 | .859 | .6916 | .5969 | .5075 | .4423 |
| .3 | 1.011 | .8412 | .7346 | .6544 | .5884 |
| .4 | 1.302 | 1.0036 | .8923 | .8094 | .7414 |
| .5 | 1.57 | 1.2014 | 1.0719 | .9808 | .9080 |
| .6 | | | 1.3219 | 1.1934 | 1.1041 |
| .7 | | | | | 1.4232 |
| .582 | | 1.57 | | | |
| .635 | | | 1.57 | | |
| .677 | | | | 1.57 | |
| .711 | | | | | 1.57 |

-continued

TABLE OF OUTPUT BEAM ANGLES

| A | H = 1.0 | H = 0.5 | H = 0. | H = −1.0 | H = −2.0 |
|---|---|---|---|---|---|
| −.3 | | | | | |
| −.2 | | | | | |
| −.1 | −.0381 | −.09 | −.1402 | | |
| 0 | .1025 | .0503 | 0 | −.102 | |
| .1 | .2431 | .1906 | .1402 | .038 | −.08 |
| .2 | .3851 | .3323 | .2819 | .18 | .064 |
| .3 | .5304 | .4773 | .4265 | .325 | .211 |
| .4 | .6821 | .628 | .5766 | .475 | .362 |
| .5 | .8454 | .7888 | .7358 | .633 | .523 |
| .6 | 1.0319 | .969 | .9116 | .804 | .693 |
| .7 | 1.2863 | 1.1969 | 1.1242 | 1.0 | .882 |
| .8 | | | | 1.266 | 1.113 |
| .582 | | | | | |
| .635 | | | | | |
| .677 | | | | | |
| .711 | | | | | |
| .742 | 1.57 | | | | |
| .769 | | 1.57 | | | |
| .795 | | | 1.57 | | |
| .843 | | | | 1.57 | |
| .889 | | | | | 1.57 |

The portion of the table inside the rectangular boxes indicates the limiting cases due to total internal reflection, using plexiglass as the material for cylinder 12. Total internal reflection causes no output beam. The table provides the output beam angle for any combination of tilt angle of the disk and the insertion depth of the disk. It is readily apparent therefrom that a desired output beam angle may be obtained by a variety of combinations of insertion depth of the rod and disk tilt angle. For example, using cylinder axis 64 as the reference, an output angle of 0.4radians can be achieved by using an disk tilt angle of −0.1 radians with an insertion depth (H) of 3.5 inches, or by using an a disk tilt angle of 0 radian with an insertion depth of 3.0 inches. Yet another way to achieve an output angle of 0.4 radians is to use a disk tilt angle of +0.25 radians (by interpolation) with an insertion depth of 0.5 inches.

Figure 7:
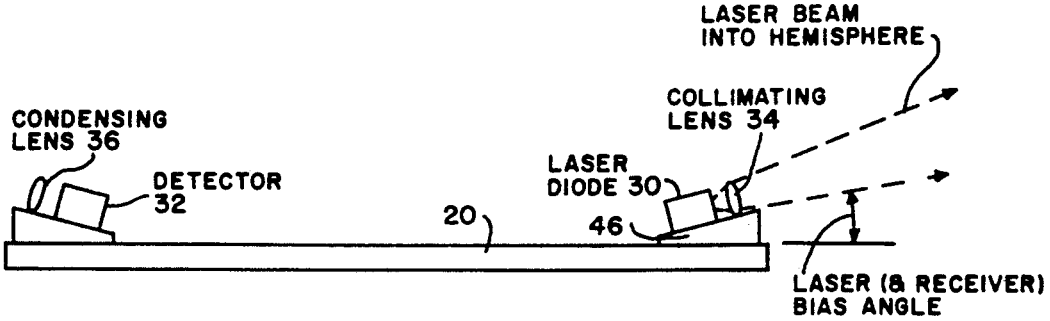
FIG. 7 is a vertical cross-sectional view of the disk and shows placement of optical elements and incorporation of positive angular bias.

However, the table used here is somewhat limited in that it is asymmetric in disk tilt angles. That is, −0.3 radians is the most "aft" angle of the disk tilt while +0.5 to +0.89 radians is the most "forward," depending on the insertion depth selected. Disk 20 is planar and provides, for example, −0.4 radians of tilt angle on one half if +0.4 radians is chosen for tilt angle on the opposite half. These values of tilt angles do not appear on the table. In essence, the table is only usable for disk tilt angles between −0.3 and +0.3 radians. This limitation does not allow much fuse output beam angle variation, if the table is to be used with the fuse. One way to render the table more versatile is to position laser diodes 30 and detectors 32 on disk 20 as shown in FIG. 7.

Laser diodes 30, collimating lenses 34, detectors 32 and condensing lenses 36 may be mounted on wedge 46 on disk 20. Such mounting provides positive angular bias to the laser diodes, detectors and the lenses, so that during the actual operation of the fuse, the disk tilt angle chosen is added to the built-in bias angle. For example, if the built-in bias angle is +0.2 radians, then a tilt angle of +0.3 radians would result in +0.5 radians on one half of disk 20 and −0.1 radians for the other half of disk 20. These values are easily found on the table. Such positioning of laser diodes, detectors and lenses render the table much more widely useful. The degree of bias angle needed can be predetermined and built into the fuse at the time of fabrication of the fuse to optimize the missile performance against targets. A large bias angle sharpens the conical beam outputs obtainable add is effective in detecting faster targets whereas a small bias angle broadens them and is more suitable in detecting slower targets.

Figure 8:
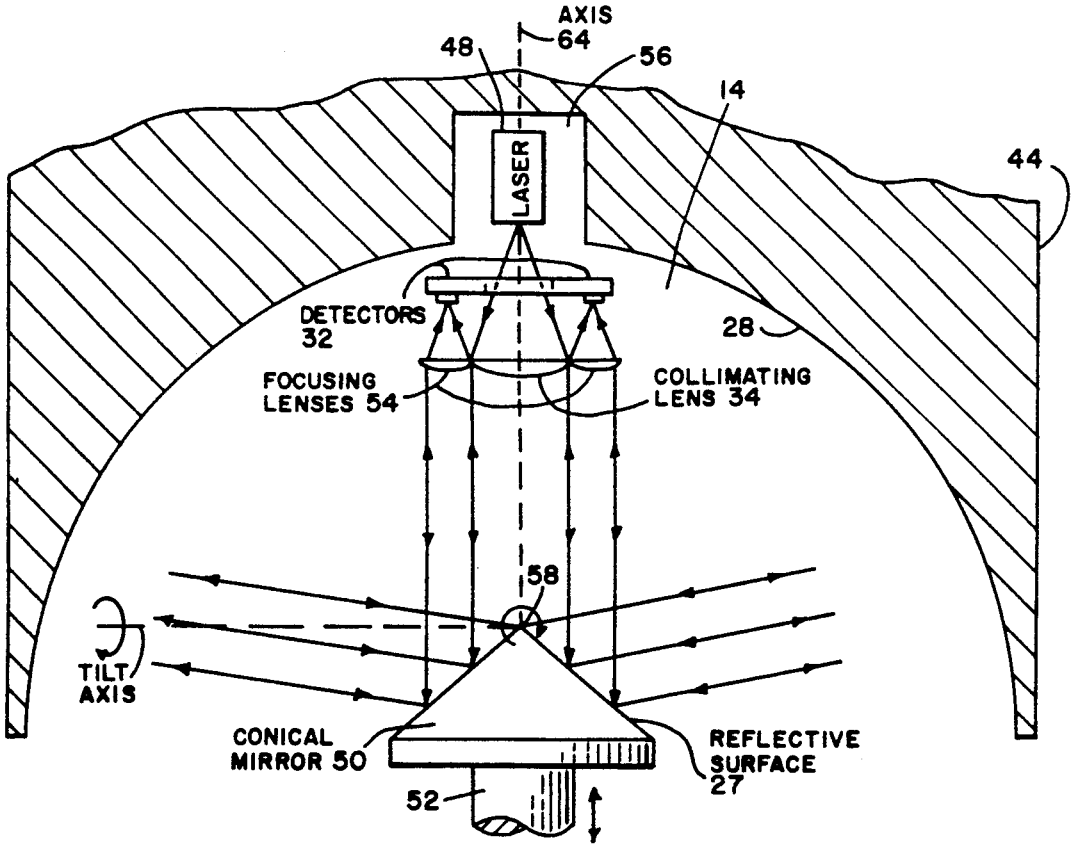
FIG. 8 gives an alternative configuration of the fuse.

An alternative to disk 20 is shown in FIG. 8. In this configuration, a single powerful laser 48 is positioned inside a hollow 56 above the meridian of hemispherical cavity 14 and is suitably secured in place. Light emanating from the laser impinges on collimating lens 34 and, in the collimated state, strikes the tiltable conical mirror 50 whose apex 58 is colinear with cylindrical axis 64. Therefrom, light reflects toward hemispherical surface 28 and continues through surfaces 28 and 44 to proceed outwardly into target space. If and when the light encounters a target, then a part of the light is reflected by the target back to fuse 4 within missile 6. Reflected light enters the hemispherical cavity and impinges on conical mirror 50 and is further reflected therefrom to focusing lenses 54 which are arranged in an annulus above the conical mirror and centered around apex 58 of the mirror. Focusing lenses 54 focus the reflected light and transmit the light to detectors 32 which are arranged in an annulus above focusing lenses 54, and again centered around apex 58 of conical mirror 50. Collimating lens 34 may be located either in the aperture of the annulus of focusing lenses 54 or in the aperture of the annulus of detector 32, as long as it is in the path of light emanating from laser 48 and suitably positioned to collimate the light around apex 58. Pre-amplifier 40, comparator 42 and the warhead fire fuse are coupled to detectors 32 in an order and manner similar to those described above for the fuse configuration that contains the disk. Conical mirror insertion depth is controlled by shaft 52 and mirror tilt must be centered about apex 58. The bias angle is determined by selection of the size of the apical angle of the mirror at the time of fabrication.

Although particular embodiments and form of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A device for detecting the presence of an object in space, comprising: a solid, optically transparent cylinder having a top and a base, said cylinder further having a cavity at said base, a disk positioned inside said cavity, said disk having a first surface and a second surface, a means to support said disk inside said cavity, a means to control the insertion depth of said disk within said cavity, a means to tilt said disk in any plane that intersects the vertical axis of said cylinder, light emitting apparatus to emit laser light outwardly toward space, detecting apparatus to receive light impinging thereon, said light being reflected from an object in space, said emitting apparatus and detecting apparatus being mounted on said first surface of said disk.

2. A device as set forth in claim 1, wherein said cavity is hemispherical.

3. A device as set forth in claim 2, wherein said supporting means is a plurality of rods positioned for movement inside said cavity in parallel with the vertical axis of said cylinder, said rods having tops and bottoms, said tops suitably coupled to said second surface of said disk and said control means is a drive motor coupled to each of said bottoms of said rods to vary insertion depth of said rods within said cavity.

4. A device as set forth in claim 3, wherein said light emitting apparatus further comprises a plurality of laser diodes to produce laser light, a laser driver coupled to said laser diodes to supply appropriate power to said laser diodes and collimating lenses suitably positioned in the path of the light emitted by said laser diodes to collimate said laser light.

5. A device as set forth in claim 4, wherein said light detecting apparatus further comprises detectors to receive light incident thereon, focusing lenses positioned between incident light and said detectors to focus the light before the light impinges on said detectors, a pre-amplifier coupled to said detectors to strengthen the light received by said detectors, and a comparator coupled to said pre-amplifier to distinguish between background illumination and light reflected from an object in space.

6. A device as set forth in claim 5, wherein said comparator is further coupled to a triggering mechanism to fire in the detected direction of the object.

7. A device as set forth in claim 6, wherein a suitable bias angle is incorporated between said apparati and said first surface of said disk.

8. A device for detecting the presence of an object in space, comprising: a solid, optically transparent cylinder having a top and a base, said cylinder further having a hemispherical cavity at said base, a cone having a reflective outer surface, said cone being inserted in said cavity such that the apex of said cone points toward the meridian of said cavity, a means to vary the insertion depth of said cone within said cavity, a means to tilt said cone at any angle relative to the vertical axis of said cylinder, a laser, said laser suitably mounted at the meridian of said cavity to illuminate said cone for outward reflection from said cone toward space, a collimator positioned in the beam path to collimate a laser beam emitted by said laser, a plurality of light detector elements, said detector elements positioned between said laser and said cone, a plano-convex toroidal lens, said lens being positioned between said detector elements and said cone, said lens further being positioned to receive reflected light from said reflective conical surface and focus the light onto said detector elements.

9. A device as set forth in claim 8, wherein said plurality of detector elements is arranged in an annulus, said annulus being centered around the vertical axis of said cylinder and said plano-convex toroidal lens is parallel with said plane on which said detector elements lie.

10. A device as set forth in claim 9, wherein, said collimator is located between said laser and said detector elements, said collimator further being centered around the vertical axis of said cylinder.

11. A device as set forth in claim 10, wherein the diameters of the apertures of said annulus of detector elements and said lens are both no longer than the width of the collimated laser beam.

12. A device as set forth in claim 11, wherein a pre-amplifier is coupled to said detector elements to increase the power of light impinging on said detector elements.

13. A device as set forth in claim 12, wherein a comparator is coupled to said pre-amplifier and receives output therefrom, compares said output with a predetermined level of light intensity and emits a signal when said output exceeds the predetermined intensity.

14. A device as set forth in claim 9, wherein said collimator is inserted in the aperture of said lens.

15. A method for detecting the presence of an object, comprising the steps of:

emanating laser light from at least one suitable light source, said source being positioned to utilize a variable prismatic optical system, transmitting the light outwardly in a conical output through the surfaces of the optical system, selecting the cone angle sharpness and width of the conical beam output, tilting the apical angle of conical output with respect to the vertical axis of the optical system to control the direction of the conical output, reflecting the light from an object back toward the optical system, providing an annulus of detectors inside the optical system, illuminating at least one detector with reflected light, and determining the position of the object in space by determining the position of the illuminated detector.

* * * * *